US007526994B2

(12) United States Patent
Hu

(10) Patent No.: US 7,526,994 B2
(45) Date of Patent: May 5, 2009

(54) HIGH PRECISION HYDRAULIC SYNCHRONOUS AND PROPORTIONAL FLOW DIVIDING AND FLOW COLLECTING APPARATUS

(76) Inventor: Shixuan Hu, Room 302, 15-2 Shunlong Road, Zhenhai District, 315200, Ningbo (CN)

( * ) Notice: Subject to any disclaimer, the term of this patent is extended or adjusted under 35 U.S.C. 154(b) by 364 days.

(21) Appl. No.: 11/306,715

(22) Filed: Jan. 9, 2006

(65) Prior Publication Data

US 2007/0131108 A1 Jun. 14, 2007

(30) Foreign Application Priority Data

Jan. 10, 2005 (CN) ..... 2005 1 0023195

(51) Int. Cl.
*F01B 1/00* (2006.01)
*F01B 31/10* (2006.01)

(52) U.S. Cl. ..... 92/72; 92/155

(58) Field of Classification Search ..... 92/72, 92/73, 74, 155; 91/6.5, 491, 492, 493; 417/273
See application file for complete search history.

(56) References Cited

U.S. PATENT DOCUMENTS 2,454,418 A * 11/1948 Zimmerman ..... 417/225
2,842,060 A * 7/1958 Barry ..... 92/72
3,354,786 A * 11/1967 Bedford ..... 92/157
3,975,993 A * 8/1976 Friedrichs ..... 92/72
4,222,714 A * 9/1980 Dantlgraber ..... 417/273
6,279,317 B1 * 8/2001 Morgan ..... 60/413

* cited by examiner

*Primary Examiner*—Michael Leslie
(74) *Attorney, Agent, or Firm*—Global IP Services; Tianhua Gu

(57) ABSTRACT

A high precision hydraulic synchronous and proportional flow dividing and flow collecting apparatus comprises two hydraulic motors having the same displacement and their crankshafts be connected into one crankshaft. The two hydraulic motors have a common oil inlet port, and have an individual oil exhaust port respectively. In the casing of the two hydraulic motors a plunger cylinder and a plunger piston that is matched with the plunger cylinder are provided. Between the plunger cylinder and the plunger piston an automatic compensating combined sealing unit is provided. Between the plunger piston and the linking rod lubrication damping holes are eliminated. Thereby, the leakage amount is further reduced. The advantage of the present invention are that it has the synchronous control function; the synchronous precision comes up to ±02%; it is of simple structure, high efficiency, energy saving, low cost, smooth operation noise, reliable performance and convenience in maintenance.

4 Claims, 2 Drawing Sheets

HIGH PRECISION HYDRAULIC SYNCHRONOUS AND PROPORTIONAL FLOW DIVIDING AND FLOW COLLECTING APPARATUS

CROSS REFERENCE TO RELATED APPLICATION

This application claims the benefit of a Chinese patent application No. 200510023195.2 (CN), filed on Jan. 10, 2005.

FIELD OF THE INVENTION

The present invention relates a hydraulic apparatus, particularly to a high precision hydraulic synchronous and proportional flow dividing and flow collecting apparatus by using two hydraulic motors in which their crankshafts be connected end to end. The apparatus can be used in the hydraulic system in which synchronous control is needed.

BACKGROUND ART

The conventional hydraulic flow dividing and flow collecting apparatus normally use synchronous flow dividing and flow collecting slide valve which can automatically change the damping of the flow channel or use two hydraulic motors jointed together to realize the function of dividing or collecting flow. The above-mentioned hydraulic flow dividing and flow collecting apparatuses suffer from the problem of low flow synchronous precision, therefore the conventional hydraulic flow dividing and flow collecting apparatuses are not suitable for the hydraulic systems in which high precision synchronous control is required.

SUMMARY OF THE INVENTION

The object of the present invention is to overcome the defects of the prior art and to provide a high precision hydraulic synchronous proportional flow dividing and flow collecting apparatus, which has synchronous control function and can improve the precision for the synchronous flow dividing and flow collecting apparatus.

The hydraulic synchronous proportional flow dividing and flow collecting apparatus distributes or gathers two oil flows according to fixed proportions and makes the performing elements operating synchronously in two directions automatically.

The object of the present invention is realized by the following way: A high precision hydraulic synchronous and proportional flow dividing and flow collecting apparatus comprising: a number of hydraulic motors including plunger cylinders, plunger pistons, a crankshaft, connecting rods, oil inlet ports and oil exhaust ports; said crankshafts be connected together end to end having a synchronous rotation; said oil inlet ports be connected together to be a common oil inlet port for feeding oil; each of said hydraulic motors having said oil exhaust port respectively for exhausting oil; the oil fed through said oil feeding duct be divided and output as several oil flows from said oil exhaust ports by said hydraulic motors having said synchronous rotation of crankshafts.

More particularly, a high precision hydraulic synchronous and proportional flow dividing and flow collecting apparatus comprises: Two hydraulic motors, one of oil inlet port and two of oil exhaust ports. A plunger cylinder and a plunger piston matched with the plunger cylinder are located in the casing of the hydraulic motor. The plunger piston is connected with a crankshaft by a connecting rod. Oil through tray and a planar oil distributing device are fixed on the casing of the hydraulic motor. The connecting rod is connected to a crankshaft through a shat sleeve.

The apparatus has two hydraulic motors with same displacement or proportional displacements. The crankshafts of the two hydraulic motors are connected end to end axially. The two hydraulic motors have common oil inlet port, and two of oil exhaust ports respectively.

Between the above-mentioned two hydraulic motors, the crankshaft of one hydraulic motor and the crankshaft of the other hydraulic motor are formed as a common crankshaft with a same eccentric placement (azimuth).

Between the plunger piston and the connecting rod, the connecting rod and the shaft sleeve, the shaft sleeve and the crankshaft, self-lubricating pads made of composite material are provided therein respectively.

Between the plunger cylinder and the plunger piston in the motor casing of the above-mentioned two hydraulic motors a sealing unit is provided therein, which can be compensated automatically.

The above-mentioned two hydraulic motors have a common fluid leakage duct, which is connected to two hydraulic motors respectively.

There are no lubricating holes provide with the plunger piston, connecting rod, shaft sleeve and crankshaft; thereby the leakage amount in the hydraulic motors is much reduced. A spherical pad made of composite material is provided between the plunger piston and the spherical end of the connecting rod. The composite material has self-lubrication function for friction reduction; thereby the leakage caused by oil lubrication holes in the prior art is avoided. In the apparatus except the planar oil distributing tray, all moving parts have no oil leakage thereof. Further more, the two hydraulic motors are driven by a common crankshaft; the plunger cylinders are manufactured by a same cutting tool, so the accuracy for synchronous and proportional is improved greatly.

As compared with prior art, the advantage of the present invention is obviously: 1. The present invention has precise synchronism controlling function, its precision can be achieved to ±02~±0.5%. 2. It has simple structure and low cost. 3. It has high rigidity in structure, low noise in operation, smooth operation, and reliable performance. 4. It possesses high transmission efficiency and energy saving.

PREFERRED EMBODIMENT

The present invention will be further described in details with reference to the accompanying drawings.

Figure 1:
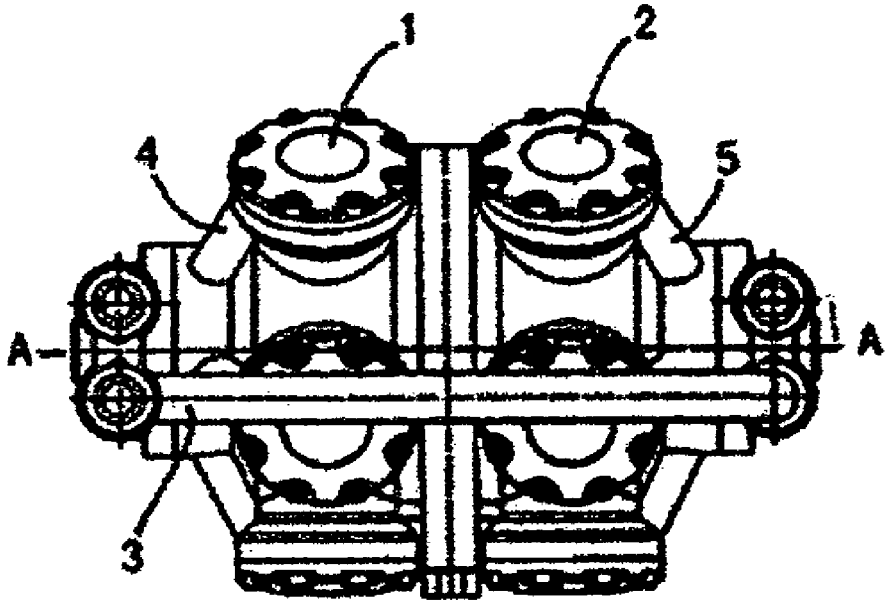
FIG. 1 is a front view of the appearance structure of the present invention.
Figure 2:
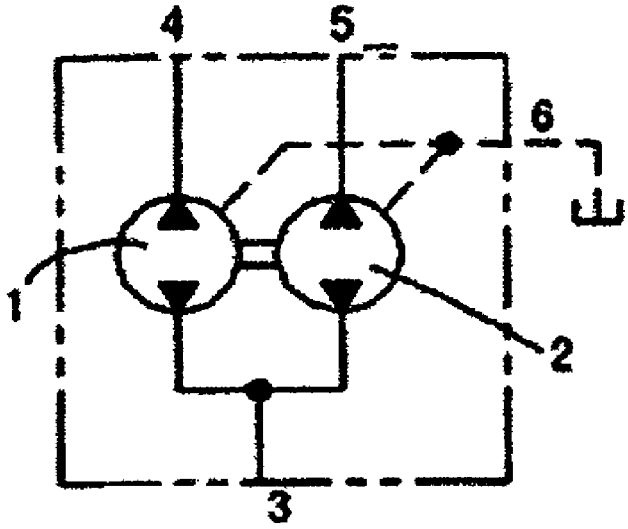
FIG. 2 is a schematic figure of the hydraulic system of the present invention.
Figure 3:
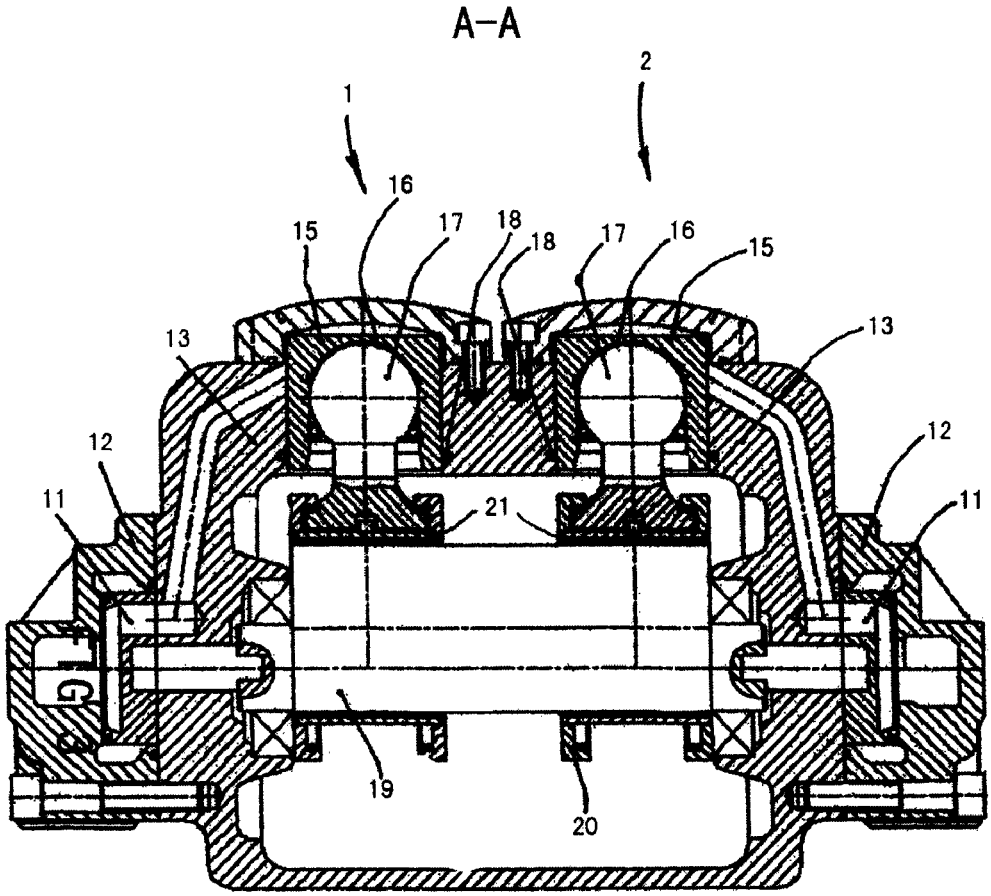
FIG. 3 is an A-A cross sectional view of the present invention shown on FIG. 1.

FIG. 1~FIG. 3 show an embodiment of high precision hydraulic synchronous and proportional flow dividing and flow collecting apparatus according to the present invention. It comprises two hydraulic motors 1 and 2 having same displacement. The casing 13 of the two hydraulic motors has plunger cylinders and plunger pistons 15 that are matched with the plunger cylinders. The plunger piston 15 is connected with a connecting rod 17. On the two ends of the hydraulic motors are provided respectively oil through tray 12 and a radial oil distributing device 11, which are fixed on the casing. The connecting rod 17 is connected to a crankshaft 19 via a shaft sleeve 21, a clamp ring 20 is provided respectively on the two ends of the connecting rod 17, which is mounted on the crankshaft 19.

The crankshafts of the hydraulic motor 1 and the hydraulic motor 2 are connected end to end axially to become one crankshaft 19. The hydraulic motor 1 and the hydraulic motor 2 have common oil inlet port 3. The hydraulic motor 1 has an oil exhaust port 4, and the hydraulic motor 2 has an oil exhaust port 5, and they have a common oil returning duct 6 connected with each other, the oil return duct 6 is an oil leakage duct.

Between the plunger cylinder and the plunger piston 15 in the motor casing 13 there is a combined sealing unit 18 with function of automatically compensation.

The crankshafts of the hydraulic motors 1 and 2 are connected together axially to become one crankshaft 19. Eccentric placements for both crankshafts are the same.

For the purpose mentioned above, in the present invention the crankshafts of the two hydraulic motors have the same displacement and are jointed end to end; the hydraulic motor 1 and 2 have the common oil inlet port 3 as well as the oil exhaust port 4 and oil exhaust port 5 respectively; therefore, the synchronous or proportional flow dividing and flow collecting are realized (refer to FIG. 1), the synchronous precision can come up to ±0.2%.

The working principle of the high precision hydraulic synchronous and proportional flow dividing and flow collecting apparatus according to the present invention is shown in FIG. 2. When operation, oil is fed from the oil inlet port 3, thereafter the oil flow is divided by the hydraulic motor 1 and hydraulic motor 2 as two identical or proportional oil flows, which are output from oil exhaust port 4 and oil exhaust port 5 for driving the performing elements. When the oil flowing is in reverse direction, the action is reversed. The apparatus of present invention guarantees from beginning to end that the oil flows are identical or proportional through the oil exhaust port 4 and the oil exhaust port 5.

In the high precision hydraulic synchronous and proportional flow dividing and flow collecting apparatus according to the present invention, between the plunger cylinder and plunger piston 15 in the motor casing 13, a combined sealing unit 18 which can be automatically compensated is used; on the connecting rod 17 which is connected with the plunger piston 15, damping holes are eliminated; thereby the oil leakage is further reduced. Between the plunger piston 15 and the spherical end of the linking rod 17 a ball pad 16 made of composite material is provided therein, as shown in FIG. 3. The composite material has the effect of self-lubrication and reducing friction, thereby the leakage caused by using oil lubrication method in prior art is avoided. All measures result in that the synchronous, flow dividing and flow collecting apparatus of the present invention has no leakage in the plunger piston and connecting rod during working.

From the above description, the high precision hydraulic synchronous and proportional flow dividing and flow collecting apparatus of the present invention only has a little hydraulic oil leakage occurred in the planar oil distribution device 11, which is disposed on the casing 13 via the oil through tray 12 as shown in FIG. 3, therefore the volumetric efficiency of the hydraulic motors in the apparatus according to the present invention is high to or up 99%.

In the other aspect, the crankshaft 19 of the two hydraulic motors is a common crankshaft, this construction fully guarantees that the eccentric distance of the crankshaft for the two hydraulic motors is same and the eccentricity has the same direction and same azimuth. As this kind of construction guarantees the two hydraulic motors working synchronously; thereby, the synchronous or proportional flow dividing or flow collecting can be achieved by changing sizes of the plunger pistons of the two hydraulic motors; finally the high precision of synchronous or proportional flow dividing or flow collecting is guaranteed under the conditions of a specified flow amount. The precision of synchronism and proportion can reach ±02.%. The apparatus of the present invention can be used in various kinds of hydraulic systems in which synchronous and proportional control are demanded.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A high precision hydraulic synchronous and proportional flow dividing and flow collecting apparatus comprising:

two hydraulic motors in a common casing, each hydraulic motor has an oil inlet port and an oil exhaust port;

each hydraulic motor including at least two plunger cylinders and at least two plunger pistons matched with said at least two plunger cylinders respectively;

each plunger piston being connected with a connecting rod, which are respectively connected to one crankshaft via a shaft sleeve;

on one end of each said hydraulic motor being provided a oil through tray and a planar oil distribution mechanism fixed on said casing;

the displacements of said two hydraulic motors being identical or proportional with each other;

said oil inlet ports of said two hydraulic motors being combined as a common oil inlet port.

2. The high precision hydraulic synchronous and proportional flow dividing and flow collecting apparatus according to claim 1, wherein between said plunger pistons and said connecting rods, between said connecting rods and said shaft sleeve, and between said shaft sleeve and said crankshaft pad made of a self-lubricating composite material are provided therein respectively.

3. The high precision hydraulic synchronous and proportional flow dividing and flow collecting apparatus according to claim 1, wherein between said plunger cylinders and said plunger pistons in the casing automatic compensating combined sealing units are provided therein respectively.

4. The high precision hydraulic synchronous and proportional flow dividing and flow collecting apparatus according to claim 1, wherein said two hydraulic motors have a common oil leakage port connected with each hydraulic motor.

* * * * *